US009586400B2

(12) United States Patent
Kato et al.

(10) Patent No.: US 9,586,400 B2
(45) Date of Patent: Mar. 7, 2017

(54) LIQUID DISCHARGE HEAD, LIQUID DISCHARGE APPARATUS, AND METHOD OF MANUFACTURING LIQUID DISCHARGE HEAD

(71) Applicant: CANON KABUSHIKI KAISHA, Tokyo (JP)

(72) Inventors: Masataka Kato, Hiratsuka (JP); Yoshinao Ogata, Nihonmatsu (JP); Toshiyasu Sakai, Kawasaki (JP); Takayuki Kamimura, Kawasaki (JP); Hiroshi Higuchi, Atsugi (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/960,569

(22) Filed: Dec. 7, 2015

(65) Prior Publication Data

US 2016/0159094 A1 Jun. 9, 2016

(30) Foreign Application Priority Data

Dec. 9, 2014 (JP) ..... 2014-248865
Jan. 14, 2015 (JP) ..... 2015-004961
Sep. 11, 2015 (JP) ..... 2015-179320

(51) Int. Cl.
*B41J 2/14* (2006.01)
*B41J 2/16* (2006.01)

(52) U.S. Cl.
CPC ..... *B41J 2/14145* (2013.01); *B41J 2/1603* (2013.01); *B41J 2/1628* (2013.01); *B41J 2002/14306* (2013.01); *B41J 2002/14419* (2013.01); *B41J 2202/11* (2013.01)

(58) Field of Classification Search
CPC ..... B41J 2/14145; B41J 2202/11; B41J 202/14306; B41J 2002/14419
See application file for complete search history.

(56) References Cited

U.S. PATENT DOCUMENTS 7,837,887 B2 11/2010 McReynolds
2010/0208010 A1* 8/2010 Inoue ..... B41J 2/14145 347/85

* cited by examiner

*Primary Examiner* — Geoffrey Mruk
(74) *Attorney, Agent, or Firm* — Canon U.S.A. Inc., IP Division

(57) ABSTRACT

A liquid discharge head including a substrate, and an energy-generating element. The substrate is provided with a flow path that penetrates through the substrate from the first surface to a second surface, the flow path supplying the liquid from the second surface side to the first surface side. The flow path includes a plurality of first flow paths and a second flow path that is positioned on the second surface side with respect to the first flow paths. The plurality of first flow paths are open on a bottom portion of the second flow path, and the plurality of first flow paths include a long flow path relatively long in a direction perpendicular to the first surface, and a relatively short flow path. The long flow path has a flow path resistance per unit length that is smaller than that of the short flow path.

18 Claims, 7 Drawing Sheets

LIQUID DISCHARGE HEAD, LIQUID DISCHARGE APPARATUS, AND METHOD OF MANUFACTURING LIQUID DISCHARGE HEAD

BACKGROUND OF THE INVENTION

Field of the Invention

The present disclosure relates to a liquid discharge head that discharges liquid, a liquid discharge apparatus that includes the liquid discharge head, and a method of manufacturing the liquid discharge head.

Description of the Related Art

There is an ink jet printing apparatus, serving as an example of a liquid discharge apparatus, including a liquid discharge head in which energy-generating elements in the liquid flow paths are driven to add energy to liquid inside the liquid flow paths and liquid is discharged from discharge ports onto a printing medium. U.S. Pat. No. 7,837,887 discloses a method of forming liquid supply passages serving as through holes in a substrate of a liquid discharge head. In the above method, a wafer (a silicon substrate) that includes first and second flat surfaces is prepared, a plurality of first flow paths are formed from the first flat surface by etching, and a second flow path that is connected to the first flow paths is formed by etching from the second flat surface towards the first flat surface. The portions in which the first flow paths and the second flow path are connected to each other constitute liquid supply paths that penetrate the substrate. It is desirable to form the first flow paths and the second flow path by reactive ion etching (RIE) that is a type of dry etching since through holes perpendicular to the substrate can be formed using an etching gas. Typically, reactive ion etching is a method of forming a predetermined shape by introducing a reactant gas inside a process chamber and turning the reactant gas into plasma, and using the reactant gas turned into plasma to etch the treatment surface of the substrate. Specifically, the substrate is fixed to a lower electrode inside the process chamber with, for example, an electrostatic chuck and reactant gas is supplied from micropores of an upper electrode to which a high frequency power source is connected between the lower electrode. The supplied reactant gas is turned into plasma between the upper electrode and the lower electrode and etches the substrate such that a predetermined shape is formed.

As illustrated in FIG. 7A, it is known that when forming flow paths using reactive ion etching described above after disposing an etching mask 41 on a substrate 11, the bottom surface of the flow path turns into a rounded shape as illustrated in FIGS. 7B and 7C. This is because the amount of etching gas (etchant) contributing to etching supplied to the center portion of the etching pattern and the amount supplied to the edge portion of the etching pattern are different. In FIG. 7B, solid line arrows illustrate that the amount of etchant supply is high and broken line arrows illustrate that the amount of etchant supply is low. When assuming that the second flow path 13 is a common flow path and the first flow paths 12 are independent flow paths that are in communication with the common flow passage, as illustrated in FIG. 7C, since the bottom portion of the second flow path, that is, the bottom portion of the common flow path has a rounded shape, the length of the plurality of independent flow paths in communication with the bottom portion are not uniform. In other words, a difference of $\Delta L$ is created between a length L of the first flow paths 12 in communication with the portion around the center (near the center portion) of the second flow path 13 and the length L' of the first flow path 12 in communication with the portion around the outside (near the peripheral portion) of the second flow path 13. Specifically, while it depends on the etching conditions, when the second flow path 13 is formed by etching with an etching amount E of about 500 μm, a length difference $\Delta L$ of about 10 to 200 μm is created.

In an ink jet printing apparatus that is a type of liquid discharge apparatus, in order for high-speed recording, one may conceive of increasing the discharge frequency of the liquid discharge head. The upper limit of the discharge frequency is determined by the time (refill time) it takes for the liquid to be supplied to the liquid chamber 14 that leads to the discharge ports 17 and to be filled after discharge of liquid. As the refill time becomes shorter, recording can be performed with higher discharge frequency. Furthermore, it is considered that, in order to obtain a printed image with a high definition, it is effective to adopt a method that improves the resolution by making the volume of the discharged liquid small and narrowing the arrangement intervals of the discharge ports 17. In particular, discharge of uniform and small volume droplets and accurate application onto the printing medium are required. Conversely, as described above, when the lengths of the plurality of independent flow paths (first flow paths 12) are different, since each flow path resistance to the corresponding energy-generating element 15 from each individual flow path is different, it is difficult to stabilize the refill time and perform stable discharge of uniform and small volume droplets.

Accordingly, the present disclosure provides a liquid discharge head, a liquid discharge apparatus, and a method of manufacturing the liquid discharge head, in which variation in flow path resistance of flow paths that are connected to discharge ports are small.

SUMMARY OF THE INVENTION

The liquid discharge head of the present disclosure includes a substrate and an energy-generating element that is provided on a first surface side of the substrate and that generates energy to discharge liquid. The substrate is provided with a flow path that penetrates through the substrate from the first surface to a second surface that is a surface on another side and the flow path supplies the liquid from the second surface side to the first surface side. The flow path includes a plurality of first flow paths and a second flow path that is positioned on the second surface side with respect to the first flow paths. The plurality of first flow paths open on a bottom portion of the second flow path, and the plurality of first flow paths include a long flow path that is relatively long in a direction perpendicular to the first surface, and a short flow path that is relatively short in the direction perpendicular to the first surface. The long flow path has a flow path resistance per unit length that is smaller than a flow path resistance per unit length of the short flow path.

Further features of the present invention will become apparent from the following description of exemplary embodiments with reference to the attached drawings.

DESCRIPTION OF THE EMBODIMENTS

Figure 1:
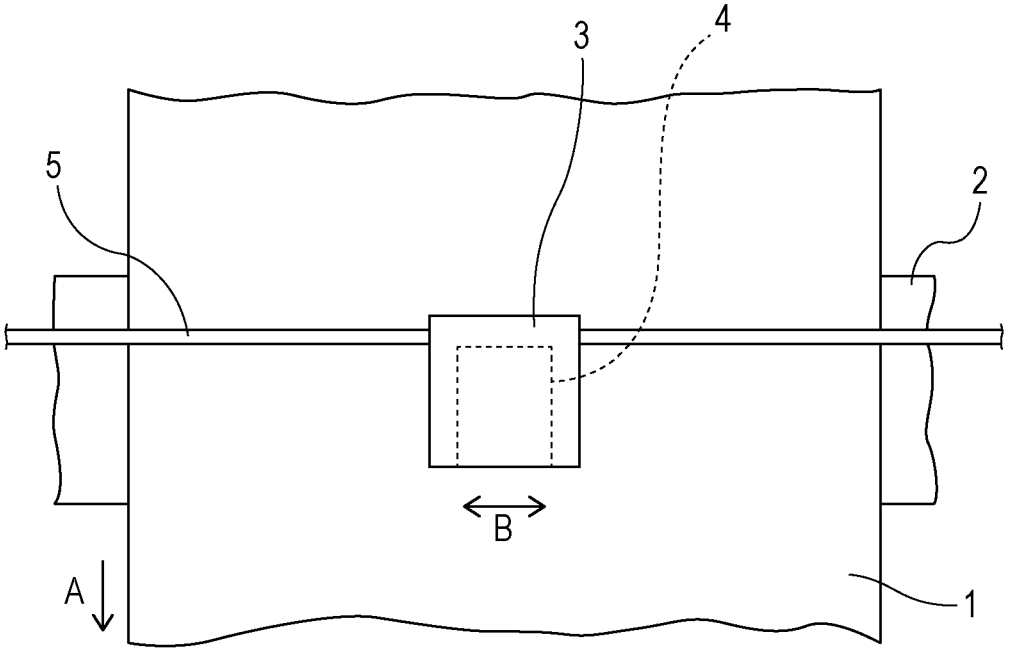
FIG. 1 is a plan view schematically illustrating an essential portion of a liquid discharge apparatus including a liquid discharge head.

Hereinafter, exemplary embodiments of the present disclosure will be described with reference to the drawings. FIG. 1 is a plan view schematically illustrating an essential portion of a liquid discharge apparatus including a liquid discharge head of the present disclosure. As illustrated in FIG. 1, the liquid discharge apparatus of the present exemplary embodiment includes a support mechanism such as a platen 2 that supports and conveys a printing medium 1 such as print paper, and a carriage 3 that is disposed at a position facing the printing medium 1 and that reciprocates in a direction B that is practically orthogonal to a convey direction A of the printing medium 1. A liquid discharge head (an inkjet printing head) 4 is mounted on the carriage 3. In a state in which the printing medium 1 is at a stop, the carriage 3 moves along a rail 5 in the width direction B of the printing medium 1 and the liquid discharge head 4 mounted on the carriage 3 discharges and applies droplets (ink droplets) on the printing medium 1 at an appropriate timing. After ending a single scan of the carriage 3, the printing medium 1 is conveyed a predetermined distance in the convey direction A such that the unrecorded portion of the printing medium 1 faces the carriage 3. Then, the carriage 3 is moved and the liquid from the liquid discharge head 4 is discharged once more. As described above, the carriage 3 being moved and the liquid from the liquid discharge head 4 being discharged, and the printing medium 1 being conveyed are alternately repeated so as to perform recording through discharge of liquid onto the printing medium 1.

Figure 2A:
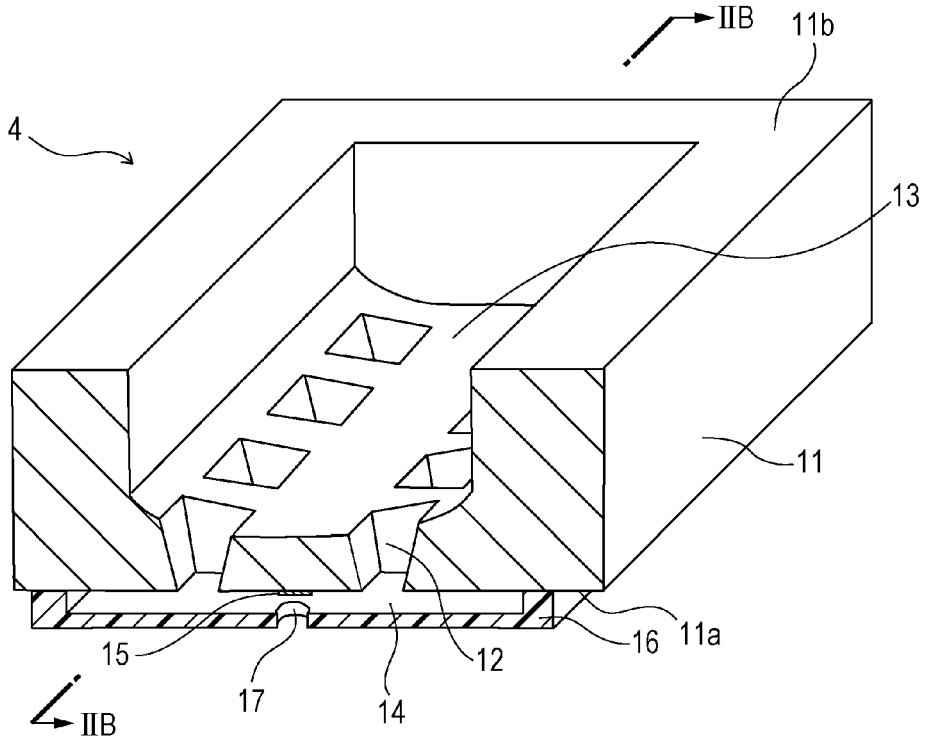
FIG. 2A is a cut-away perspective view and FIG. 2B is a cross-sectional view of a portion of the liquid discharge head.
Figure 2B:
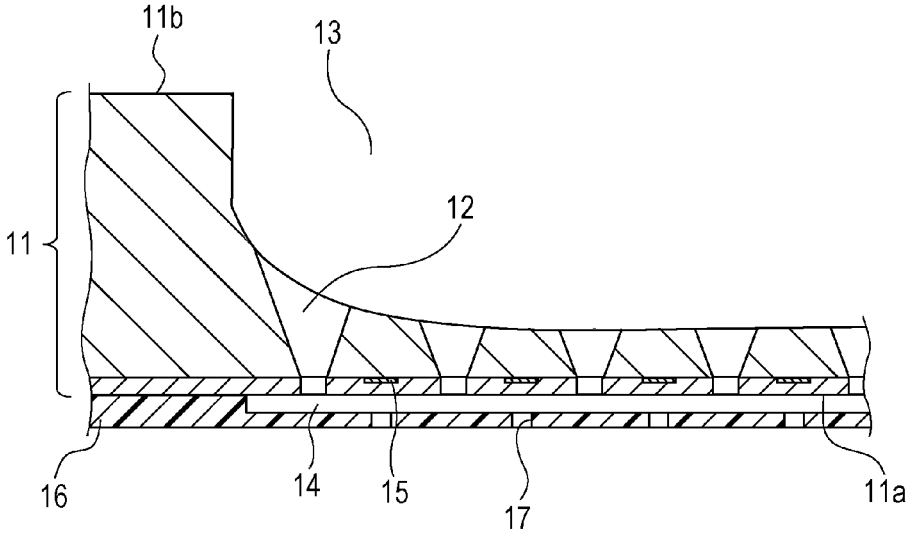

FIG. 2A illustrates a partially cut-away perspective view of the liquid discharge head 4, and FIG. 2B illustrates a cross-sectional view of an essential portion of the above taken along line IIB-IIB. The liquid discharge head 4 is configured such that a discharge port forming member 16 is stacked on a substrate 11. A silicon substrate, for example, may be used as the substrate 11. First flow paths 12 and a second flow path 13 for supplying liquid towards the discharge port forming member 16 is formed in the substrate 11. Each of the first flow paths 12 and the second flow path 13 are in communication with each other and form flow paths (liquid supply passages) that serve as through holes that penetrate the substrate 11 in a plate thickness direction. Energy-generating elements for discharging liquid are provided on a first surface 11*a* of the substrate 11 on which the discharge port forming member 16 is stacked. In a case in which the substrate 11 is a silicon substrate, it is desirable that the first surface 11*a* is a surface with a crystal orientation of (100). An example of each energy-generating element provided on the first surface side of the substrate 11 includes a heating element such as an electrothermal transducer element that generates thermal energy that causes film boiling of the liquid in accordance with the energization or a piezoelectric transducer. A recessed portion that forms a liquid chamber 14 is formed in the discharge port forming member 16 that is stacked on the first surface 11*a* of the substrate 11, and the energy-generating elements (heating elements) 15 are located inside the liquid chamber 14. Discharge ports 17 that discharge liquid are formed in the discharge port forming member 16 at positions facing the energy-generating elements 15. Strictly speaking, the substrate 11 may be a multilayered structure in order to embed the heating elements; however, it is deemed as a single member. The discharge port forming member 16 may be formed of a photosensitive resin or an inorganic material, for example. With flow paths that penetrate the substrate 11 from the first surface 11*a* to the second surface 11*b* that is a surface on the other side, liquid is supplied from the second surface 11*b* side to the first surface 11*a* side of the substrate 11. Energy is added with the energy-generating elements 15 to the supplied liquid in the liquid chamber 14. The liquid is discharged from the liquid discharge ports 17 with the above energy.

FIG. 2B illustrates a cross-sectional view (a cross-sectional view taken long line IIB-IIB of FIG. 2A) of the liquid discharge head 4. The second flow path 13 having a recessed shape that open on the second surface 11*b* side has a rounded shape. In other words, the second flow path 13 has a shape in which the bottom portion is deep at the center (a middle portion) and is shallow in the peripheral portion (the edge) that is the outer side of the bottom portion. The second flow path 13 is formed by performing reactive ion etching from the second surface 11*b* of the substrate 11. The first flow paths 12 that are formed by performing reactive ion etching from the first surface 11*a* of the substrate 11 are flow paths that communicate the first surface 11*a* and the bottom portion of the second flow path 13 to each other. A plurality of first flow paths 12 are open in the bottom portion of the second flow path 13. The second flow path 13 is positioned on the second surface 11*b* side with respect to the first flow paths 12. In other words, the first flow paths 12 are positioned on the first surface 11*a* side with respect to the second flow path 13. The plurality of first flow paths 12 includes flow paths (hereinafter, referred to as "long flow paths") that are relatively long in a direction perpendicular to the first surface 11*a*, and flow paths (hereinafter, referred to as "short flow paths") that are relatively short. Among the plurality of first flow paths 12, the long flow paths open on the outer side of the bottom portion of the second flow path with respect to the short flow path.

A feature of the present disclosure is that among the plurality of first flow paths, a flow path resistance per unit length of each long flow path is smaller than the flow path resistance per unit length of each short flow path. In the present exemplary embodiment, in each of the first flow paths 12, an area (an opening area) in the first surface 11*a* is larger than a portion (the bottom portion of the second flow path 13) that is in communication with the second flow path 13. More specifically, each first flow path 12 is formed so that the sectional areas become, from a position that is near the energy-generating elements 15, gradually larger as the first flow path 12 is farther away from the energy-generating elements 15 (from the first surface 11*a* side towards the second surface 11*b* side).

As described above, since the second flow path 13 is formed so as to have a rounded shape, the plurality of first flow paths (independent flow paths) 12 include flow paths that are long and flow paths that are short in the direction perpendicular to the first surface 11*a*. If sectional areas of each of the first flow paths 12, the sectional areas extending in a direction parallel to the first surface 11*a*, are uniform from the first surface 11*a* side towards the second surface 11*b* side, then the flow path resistances in the long flow paths will be large and the flow path resistances in the short flow paths will be small. However, in the present exemplary embodiment, the area of each opening open in the bottom portion of the second flow path 13 is different according to the length of the corresponding first flow path 12. Specifically, while the areas of the openings of the plurality of first flow paths 12 in the first surface 11*a* (among the plurality of first flow paths 12) are practically the same, the areas of the openings of the long flow paths that open in the bottom portion of the second flow path are larger than those of the short flow paths. Accordingly, the flow path resistances between the long flow paths and the short flow paths can be kept small such that influence caused by variation in flow path resistances due to the difference in the lengths of the first flow paths (independent flow paths) 12 can be restrained from being exerted. As a result, refill time of each flow path can be stabilized and uniform and small volume droplets can be discharged in a stable manner.

In the present exemplary embodiment, in each of the long flow paths, the opening that is open in the bottom portion of the second flow path 13 is larger than the opening that is open in the first surface 11*a*. Furthermore, the sectional areas extending in the direction parallel to the first surface 11*a* become gradually larger from the first surface 11*a* side towards the second surface 11*b* side. A method of forming such flow paths by reactive ion etching will be described below with reference to FIGS. 3A to 3D. The method includes a Bosch process in which etching and coating are repeated, and a non-Bosch process in which the side walls of the flow paths are protected at the same time with the etching.

Figure 3A:
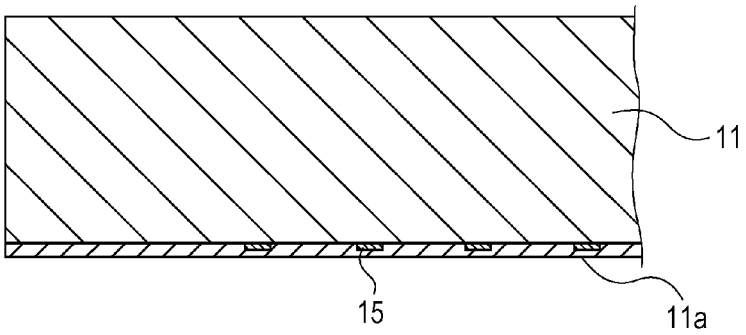
FIGS. 3A to 3D are cross-sectional views illustrating a manufacturing process of the liquid discharge head.
Figure 3B:
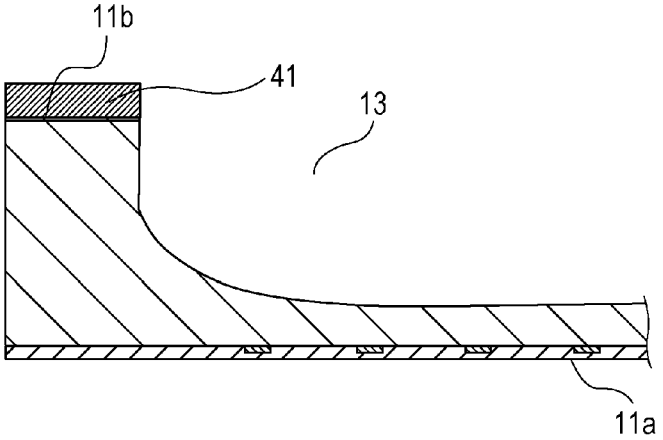
Figure 3C:
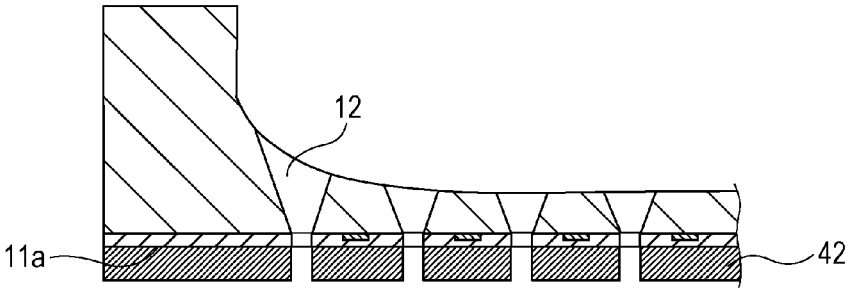
Figure 3D:
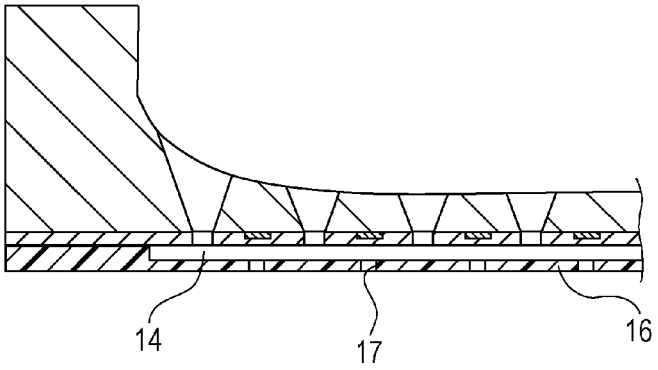

As illustrated in FIG. 3A, the substrate 11 is prepared. Subsequently, as illustrated in FIG. 3B, the second flow path 13 is formed using an etching mask 41. Subsequently, as illustrated in FIGS. 3C and 3D, the first flow paths 12 are formed.

In forming the flow paths, it is desirable that dry etching using an inductive coupling plasma (ICP) device is applied; however, other dry etching devices adopting other plasma source methods may be used. For example, dry etching using an electron cyclotron resonance (ECR) device or a magnetic neutral line discharge (NLD) plasma generating device may be performed.

In the case of a Bosch process, for example, $SF_6$ gas can be used as the gas for etching, and, for example, $C_4F_8$ gas can be used as the coating gas. Typical etching conditions when forming flow paths are a gas pressure in the range of 0.1 Pa to 50 Pa and a gas flow rate in the range of 50 sccm to 1000 sccm for both the etching step and the coating step. Furthermore, by controlling the duration of the etching step in the range of 5 seconds to 20 seconds and the duration of the coating step in the range of 1 second to 10 seconds, flow paths with high perpendicularity can be formed.

On the other hand, in etching to gradually increase the sectional areas of the first flow paths 12, a step of proactively removing a side wall protection film formed by coating is introduced in the etching step. Specifically, adjustment of time and supply of power to the platen (an application of an electric charge to the platen 2) are included. For example, the etching time is increased by 10% or more with respect to the above-described conditions for forming the flow paths with high perpendicularity, and during the etching time, power in the range of 50 W to 200 W is applied to the platen. By applying power to the platen, ions can be attracted to the substrate 11 (the object to be etched) and the coated side wall protection film can be proactively removed. By performing etching and the like under such etching conditions, the first flow paths 12 are each formed with a shape having sectional areas that become gradually larger. Note that in the present disclosure, not only through control of the duration of the etching step and the power to the platen, the desired etching can be carried out through control of parameters, such as the gas pressure, the gas flow rate, and the coil power. Furthermore, the conditions of the coating step can be changed to make the side wall protection film thinner.

Subsequently, specific conditions of a non-Bosch process in which the side walls are protected during etching will be described. In the above case, $SF_6$ gas and $O_2$ gas can be used. In the case of the non-Bosch process, etching and coating are not repeated alternately, but etching is performed while having a byproduct of the etching adhere on the side walls; accordingly, although the perpendicularity is inferior to that of the Bosch process, a virtually perpendicular etching can be performed. Etching can be performed by controlling the gas pressure in the range of 0.1 Pa to 50 Pa and the gas flow rate in the range of 50 sccm to 1000 sccm. In the present exemplary embodiment, etching conditions that increases the etching in the side wall direction will be employed. Specifically, by creating a low vacuum in which the gas pressure is 5 Pa or under, the gas that contributes to the etching is dispersed more such that etching in the side wall direction is performed. Note that in the present disclosure, not only through control of the gas pressure, the desired etching can be carried out through control of parameters, such as the gas flow rate, the coil power, and the power to the platen.

Figure 4A:
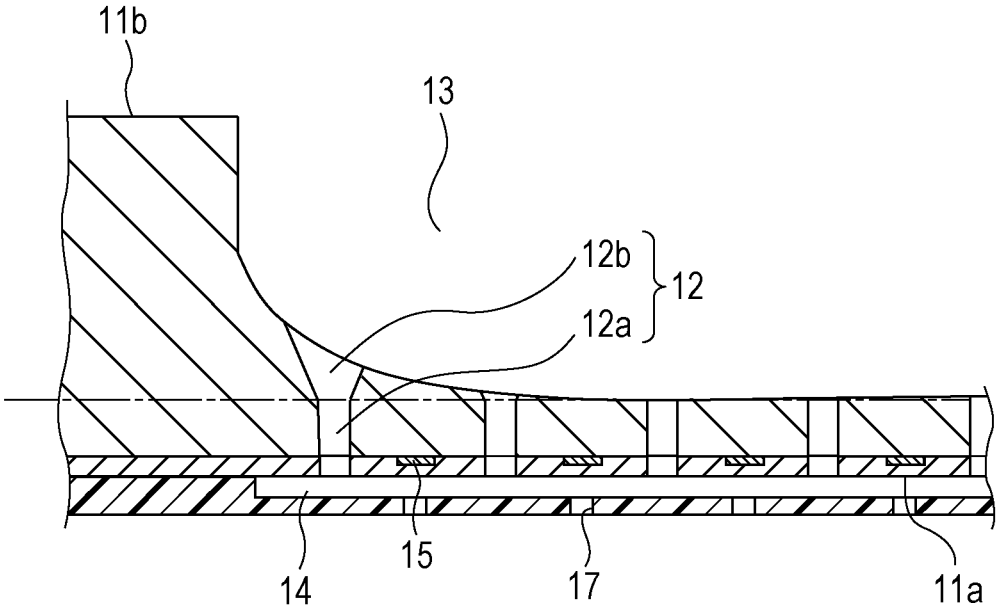
FIGS. 4A and 4B are cross-sectional views of the liquid discharge head.

In the exemplary embodiment described above, an exemplification of a form in which, among the first flow paths 12, the sectional areas of each of the long flow paths, the sectional areas extending in the direction parallel to the first surface 11*a*, become gradually larger from the first surface 11*a* side towards the second surface 11*b* side has been given; however, all of the first flow paths 12 do not have to have the above form. For example, as illustrated in FIG. 4A, among the plurality of first flow paths 12, the flow paths 12 that are relatively long may include a first portion 12*a* and a second portion 12*b*. In the first portion 12*a*, the sectional areas extending in the direction parallel to the first surface 11*a* become gradually larger from the first surface 11*a* side towards the second surface 11*b* side. In the second portion 12*b*, the sectional areas extending in the direction parallel to the first surface 11*a* are practically the same from the first surface 11*a* side towards the second surface 11*b* side.

Such flow paths are formed in the following manner, for example. The substrate 11 is first perpendicularly etched from the first surface 11*a* and at the point when the shortest first flow path 12 comes in communication with the second flow path 13, the etching conditions are changed such that the sectional areas of the first flow paths 12 become gradually larger. Consequently, each long first flow path 12 can be formed so as to include the first portion 12*a* that extend from the first surface 11*a* in which the sectional areas are uniform, and the second portion 12*b*, including the connection portion with the second flow path 13, in which the sectional areas increase. In the above, among the first flow paths 12, the short flow paths extend from the first surface 11*a* side towards the second surface 11*b* side such that the sectional areas of each short flow paths extending in the direction parallel to the first surface 11*a* are practically the same.

With such a form, since the sectional area is larger at the portion of each long first flow path 12 where the length exceeds the short first flow paths 12, it is relatively easy to adjust the sectional area so that the variation in the flow path resistance due to difference in length is reduced. Furthermore, in the present exemplary embodiment, since the portions where the areas of the openings are uniform on the first surface 11*a* side are large, there is no need to have a wide interval between the adjacent first flow paths 12 and the restriction in design is small.

Detection of the shortest first flow path 12 coming in communication with the second flow path 13 is performed with a photosensor, for example. In other words, light that is emitted when etching is performed to form the first flow paths 12 is captured, and the reduction in the amount of emitted light during etching due to decrease in the etching area of the substrate 11 caused by a portion of the first flow paths 12 coming in communication with the second flow path 13 is detected. As described above, recognition can be made that the shortest first flow path 12 has come in communication with the second flow path 13 when the amount of emitted light due to etching starts to decrease.

Etching conditions when forming the first flow paths 12 are a gas pressure in the range of 0.1 Pa to 50 Pa and a gas flow rate in the range of 50 sccm to 1000 sccm for both the etching step and the coating step. Until the shortest first flow path 12 comes in communication with the second flow path 13, the duration of the etching step is controlled so as to be in the range of 5 seconds to 20 seconds and the duration of the coating step is controlled so as to be in the range of 1 second to 10 seconds so as to perform etching with a high perpendicularity. In other words, etching is started under etching conditions in which the sectional areas become uniform. Then, at the point when the shortest first flow path 12 comes in communication with the second flow path 13, a step of proactively removing a side wall protection film formed by coating is introduced in the etching step. For example, the etching time is increased by 10% or more with respect to the condition for forming the flow paths with high perpendicularity, and during the etching time, power in the range of 50 W to 200 W is applied to the platen. In other words, at a point when at least one first flow path 12 comes in communication with the second flow path 13, the etching conditions are changed so that the sectional areas of the first flow paths 12 become larger, and etching is continued.

Figure 4B:
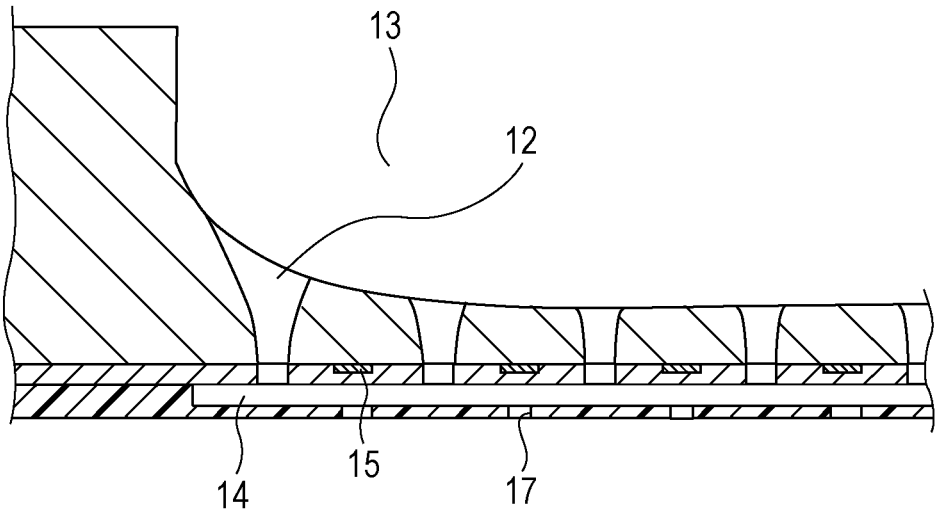

In FIG. 4A, the sectional areas of the long flow paths of the first flow paths 12 become gradually larger with a straight tapered surface. Conversely, as illustrated in FIG. 4B, each of the sectional areas of the long flow paths of the first flow paths 12 may become gradually larger with a curved surface.

Figure 5:
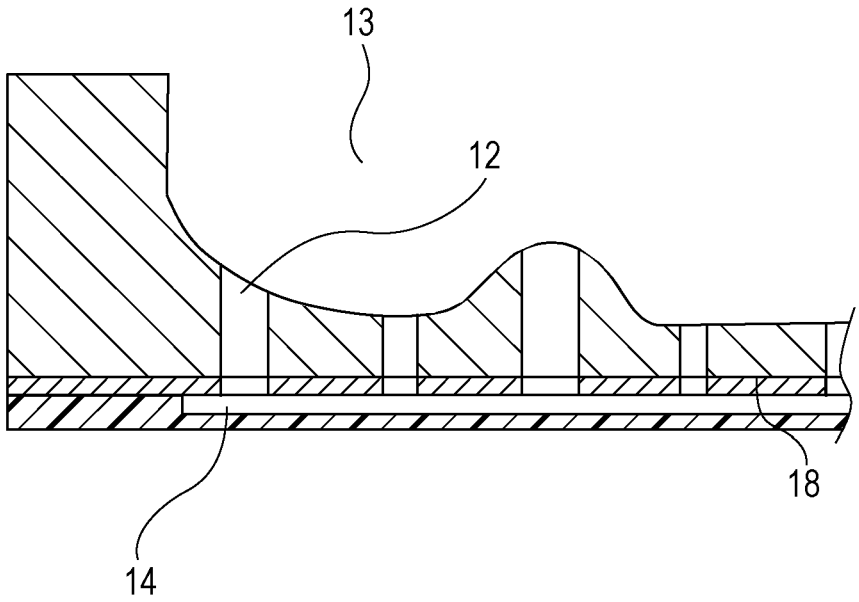
FIG. 5 is cross-sectional view of the liquid discharge head.

A case in which the second flow path 13 has a rounded shape has been described above; however, the present disclosure is not limited to the above. For example, even in a case illustrated in FIG. 5 in which the second flow path 13 has a complex shape, by making the flow path resistance per unit length of each of the relatively long flow paths smaller than that of each of the relatively short flow paths, the liquid supply performance can be made uniform. In the configuration of FIG. 5, the sectional areas of the long flow paths are larger than the sectional areas of the short flow paths, and the flow path resistance per unit length of each of the long flow paths is small.

Note that the flow path resistance per unit length is the flow path resistance per same length (unit length) of each of the flow paths with different lengths. Accordingly, in the present disclosure, while the flow path resistance of the entire flow paths is made uniform as much as possible, since the lengths of the flow paths are different between the flow paths, the flow path resistance per unit length of each of the flow paths is different.

FIGS. 6A to 6F are diagrams illustrating the openings of the first flow paths in the bottom portion of the second flow path. In a form (a first example) illustrated in FIG. 6A, first flow paths 12 at the end in a longitudinal direction X are enlarged (have longer lengths) in the longitudinal direction X and a short direction Y with respect to first flow paths 12 in the middle in the longitudinal direction X. In a form (a second example) illustrated in FIG. 6B, first flow paths 12 at the end in a longitudinal direction X are enlarged in the short direction Y with respect to first flow paths 12 in the middle in the longitudinal direction X and have the same dimension in the longitudinal direction X. In a form (a third example) illustrated in FIG. 6C, first flow paths 12 at the end in a longitudinal direction X are enlarged in the longitudinal direction with respect to first flow paths 12 in the middle in the longitudinal direction X and have the same dimension in the short direction Y. The three configurations above are particularly effective in a case such as when there is a design restriction in forming the first flow paths 12 and the second flow path 13.

Figure 6A:
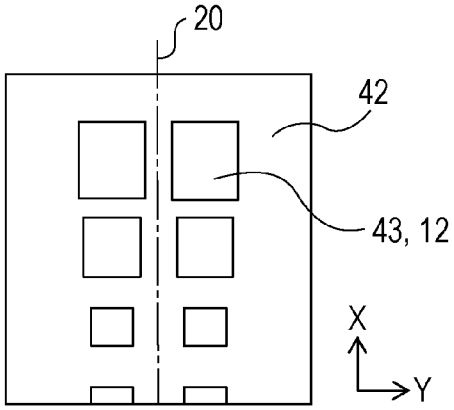
FIGS. 6A to 6F are diagrams illustrating openings of the first flow paths of the liquid discharge head.

The form illustrated in FIG. 6A is effective in a case in which it is desirable to design the first flow paths 12, the second flow path 13, or both the first flow path and the second flow path 13 to have a proportional relationship with the sectional areas and the lengths of the first flow paths 12 in the longitudinal direction X and the short direction Y. The form illustrated in FIG. 6B is effective in a case in which the arrangement intervals of the first flow paths 12 and the arrangement intervals of the energy-generating elements 15 are to be narrowed in the longitudinal direction X. The form illustrated in FIG. 6C is effective in a case in which there is a restriction in the size of the opening of the second flow path 13 in the short direction Y, specifically, in a case in which the opening of the second flow path 13 cannot be enlarged in the short direction Y and, as a result, the openings of the first flow paths 12 is restricted in the short direction Y. The form illustrated in FIG. 6C enables the first flow paths 12 and the second flow path 13 to be in communication with each other without enlarging the opening of the second flow path 13 in the short direction Y.

Figure 6D:
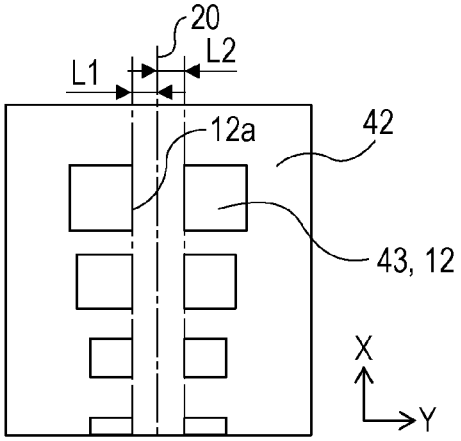
Figure 6B:
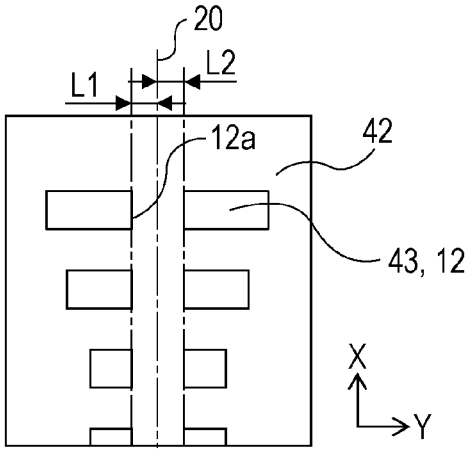

The etching mask to form the first flow paths 12 may, for example, have a shape illustrated in FIG. 6D. In a form (a fourth example) illustrated in FIG. 6D, an etching mask 42 is formed so that a plurality of first flow paths 12 are set apart from each other at the same distance with respect to an arrangement axis 20. More specifically, distances L1 and L2 in the short direction Y, which are distances between sides 12*a* of the openings of the first flow paths 12 in a first surface 18 that are near to the arrangement axis 20, and the arrangement axis 20 are made uniform in all of the first flow paths 12. In addition to the above, the first flow paths 12 are formed not with the same flow-path sectional area but are formed such that the first flow paths 12 that are near to a side wall of the second flow path 13 in the longitudinal direction X have larger flow-path sectional areas than those of the first flow paths 12 that are away from the side wall of the second flow path 13 in the longitudinal direction X. In the above, the flow-path sectional areas of the first flow paths 12 are enlarged in both the longitudinal direction X and the short direction Y. Such a form is effective in a case in which the first flow paths 12 cannot be greatly enlarged in the longitudinal direction X and the short direction Y and in a case in which the second flow path 13 cannot be greatly enlarged in the longitudinal direction X. Moreover, since the distances L1 and L2 in the short direction Y between the openings of the first flow paths 12 and the arrangement axis 20 are uniform, droplets with more stable droplet volumes can be discharged.

Figure 6E:
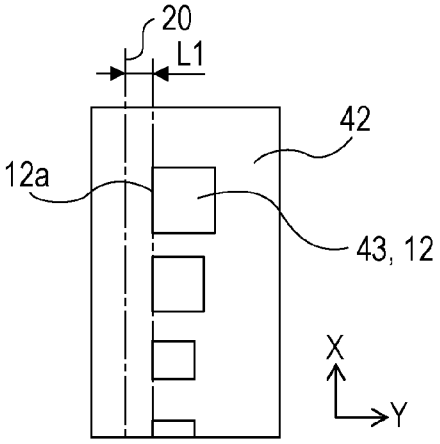
Figure 6C:
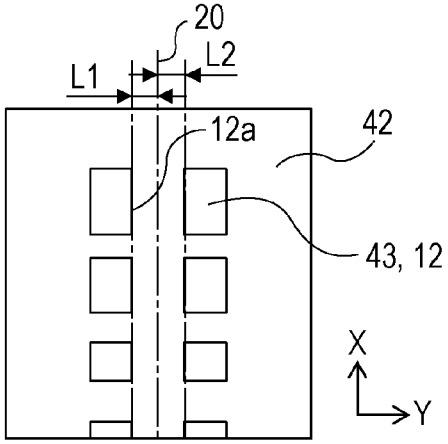

The etching mask that forms the first flow paths 12 may have another form (a fifth example) illustrated in FIG. 6E. The etching mask 42 forms the plurality of first flow paths 12 to be set apart from each other at the same distance with respect to the arrangement axis 20. More specifically, distances L1 and L2 in the short direction Y, which are distances between sides 12*a* of the openings of the first flow paths 12 in a first surface 18 that are near to the arrangement axis 20 and the arrangement axis 20, are made uniform in all of the first flow paths 12. In addition to the above, the first flow paths 12 are formed not with the same flow-path sectional area but are formed such that the first flow paths 12 that are near to a side wall of the second flow path 13 in the longitudinal direction X have larger flow-path sectional areas than those of the first flow paths 12 that are away from the side wall of the second flow path 13 in the longitudinal direction X. In the above, the flow-path sectional areas of the first flow paths 12 are enlarged in both the longitudinal direction X and the short direction Y. In the above form, only a single row of the first flow paths 12 that corresponds to the energy-generating elements 15 is provided and the liquid is supplied to the energy-generating elements 15 from only one side.

Figure 6F:
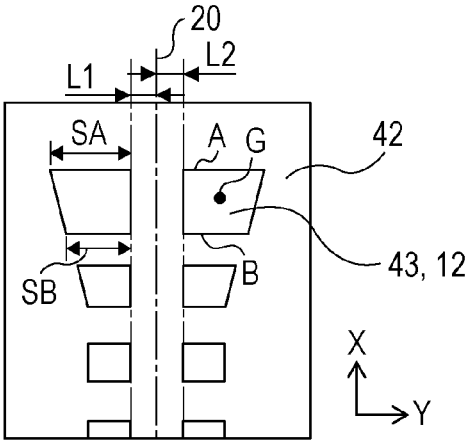
Figure 7A:
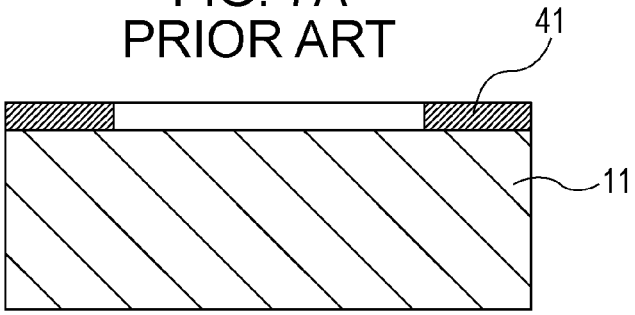
FIG. 7A PRIOR ART
FIGS. 7A to 7C are cross-sectional views of a conventional liquid discharge head.
Figure 7B:
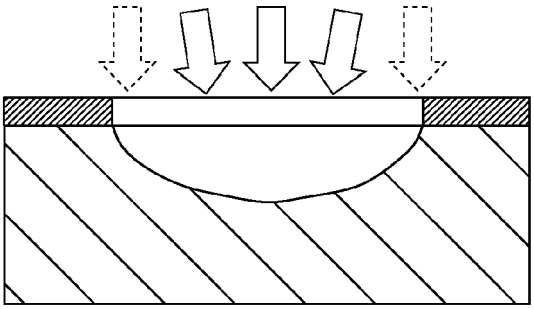
FIG. 7B PRIOR ART
Figure 7C:
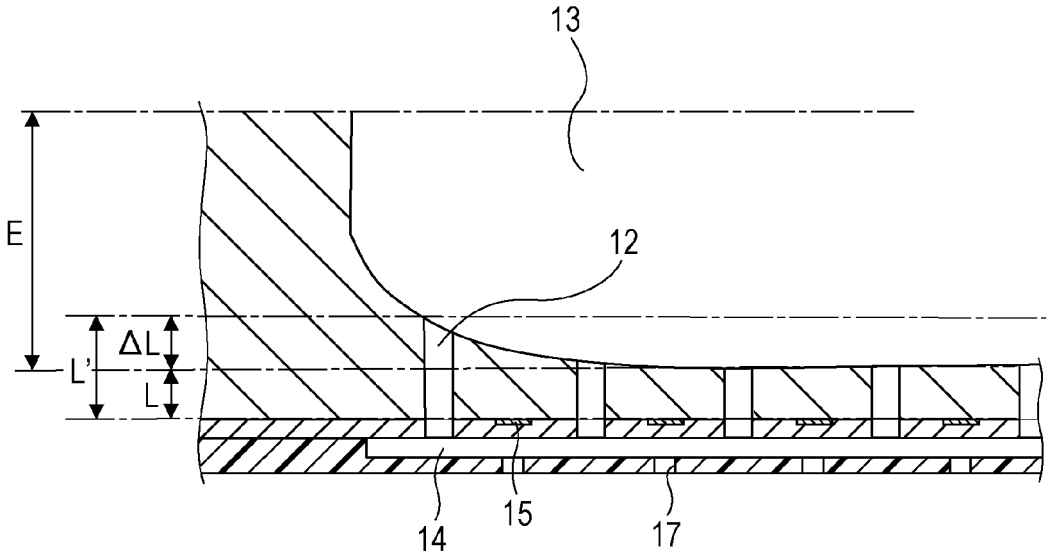
FIG. 7C PRIOR ART

The shapes of the openings for forming the first flow paths 12 in the etching mask forming the first flow paths 12 may be other than a rectangular shape and, for example, may be applied to a form (a sixth example) illustrated in FIG. 6F. In the above, a position G of the center of gravity of an opening of at least one first flow path 12 that open in the second flow path 13 is, when viewed in a thickness direction Z of the substrate 11, more near to a first portion A with respect to a second portion B. In the illustrated example, a side length SA of the first portion A and a side length SB of the second portion B satisfies a relationship SA>SB. By having the opening shapes of the first flow paths 12 to be, rather than a rectangular shape, a trapezoidal shape as illustrated in FIG. 6F, the portion of the first flow path 12 in which the flow path is long can be enlarged in a planar manner such that even in a single first flow path 12, difference in the flow path resistance can be made small in a more efficient manner.

When the liquid discharge head 4 including the substrate 11 in which the flow paths 12 and 13 are formed with the method described above is manufactured, since the flow path resistance of the flow paths substantially coincide with each other, the refill time can be short in a stable manner and, further, the volume of the discharged droplets can be small in a stable manner.

The present disclosure is capable of making the refill time of liquid after discharge of liquid uniform and, further, is capable of making the volume of the discharged liquid uniform. Accordingly, a further stable discharge of liquid can be achieved and an image with a definition that is further higher and that has high quality can be formed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-248865, filed Dec. 9, 2014, Japanese Patent Application No. 2015-004961, filed Jan. 14, 2015, and Japanese Patent Application No. 2015-179320, filed Sep. 11, 2015, which are hereby incorporated by reference herein in their entirety.

What is claimed is:

1. A liquid discharge head, comprising:

a substrate; and an energy-generating element that is provided on a first surface side of the substrate and that generates energy to discharge liquid, wherein the substrate is provided with a flow path that penetrates through the substrate from the first surface to a second surface that is a surface on another side, the flow path supplying the liquid from the second surface side to the first surface side, the flow path including a plurality of first flow paths and a second flow path that is positioned on the second surface side with respect to the first flow paths, the plurality of first flow paths being open on a bottom portion of the second flow path, and the plurality of first flow paths include a long flow path that is relatively long in a direction perpendicular to the first surface, and a short flow path that is relatively short in the direction perpendicular to the first surface, the long flow path having a flow path resistance per unit length that is smaller than a flow path resistance per unit length of the short flow path.

2. The liquid discharge head according to claim 1, wherein an area of an opening of the long flow path, the opening of the long flow path being open in the bottom portion of the second flow path, is larger than an area of an opening of the short flow path, the opening of the short flow path being open in the bottom portion of the second flow path.

3. The liquid discharge head according to claim 1, wherein an area of an opening of the long flow path, the opening of the long flow path being open in the first surface, and an area of an opening of the short flow path, the opening of the short flow path being open in the first surface, are equivalent to each other.

4. The liquid discharge head according to claim 1, wherein in the long flow path, an area of an opening that open in the first surface is larger than an area of an opening that open in the bottom portion of the second flow path.

5. The liquid discharge head according to claim 1, wherein in the long flow path, sectional areas that extend in a direction parallel to the first surface gradually become larger from the first surface side towards the second surface side.

6. The liquid discharge head according to claim 1, wherein the long flow path includes a portion in which sectional areas that extend in a direction parallel to the first surface gradually become larger from the first surface side towards the second surface side, and a portion in which sectional areas that extend in the direction parallel to the first surface are equivalent to each other.

7. The liquid discharge head according to claim 1, wherein in the short flow path, sectional areas that extend in a direction parallel to the first surface are equivalent to each other from the first surface side towards the second surface side.

8. The liquid discharge head according to claim 1, wherein the long flow path is open on an outer side of the bottom portion of the second flow path with respect to the short flow path.

9. The liquid discharge head according to claim 8, wherein the plurality of first flow paths include flow paths in which lengths of the plurality of first flow paths in the direction perpendicular to the first surface become longer as the plurality of first flow paths become positioned on an outer side with respect to a middle of the bottom portion of the second flow path.

10. A liquid discharge apparatus including the liquid discharge head according to claim 1.

11. A liquid discharge head, comprising:

a substrate; and an energy-generating element that is provided on a first surface side of the substrate and that generates energy to discharge liquid, wherein the substrate is provided with a flow path that penetrates through the substrate from the first surface to a second surface that is a surface on another side, the flow path supplying the liquid from the second surface side to the first surface side, the flow path including a plurality of first flow paths and a second flow path that is positioned on the second surface side with respect to the first flow paths, the plurality of first flow paths being open on a bottom portion of the second flow path, and the plurality of first flow paths include a long flow path that is relatively long in a direction perpendicular to the first surface, and a short flow path that is relatively short in the direction perpendicular to the first surface, an area of an opening of the long flow path open in the bottom portion of the second flow path being larger than an area of an opening of the short flow path open in the bottom portion of the second flow path.

12. The liquid discharge head according to claim 11, wherein an area of an opening of the long flow path, the opening of the long flow path being open in the first surface, and an area of an opening of the short flow path, the opening of the short flow path being open in the first surface, are equivalent to each other.

13. The liquid discharge head according to claim 11, wherein in the long flow path, an area of an opening that open in the first surface is larger than an area of an opening that open in the bottom portion of the second flow path.

14. The liquid discharge head according to claim 11, wherein in the long flow path, sectional areas that extend in a direction parallel to the first surface gradually become larger from the first surface side towards the second surface side.

15. The liquid discharge head according to any one of claim 11, wherein the long flow path includes a portion in which sectional areas that extend in a direction parallel to the first surface gradually become larger from the first surface side towards the second surface side, and a portion in which sectional areas that extend in the direction parallel to the first surface are equivalent to each other.

16. The liquid discharge head according to claim 11, wherein in the short flow path, sectional areas that extend in a direction parallel to the first surface are equivalent to each other from the first surface side towards the second surface side.

17. The liquid discharge head according to claim 11, wherein the long flow path is open on an outer side of the bottom portion of the second flow path with respect to the short flow path.

18. The liquid discharge head according to claim 17, wherein the plurality of first flow paths include flow paths in which lengths of the plurality of first flow paths in the direction perpendicular to the first surface become longer as the plurality of first flow paths become positioned on an outer side with respect to a middle of the bottom portion of the second flow path.

* * * * *